US007401691B2

(12) United States Patent
Ishikawa et al.

(10) Patent No.: US 7,401,691 B2
(45) Date of Patent: Jul. 22, 2008

(54) CONVEYER APPARATUS HAVING FOOTSTEPS

(75) Inventors: Yoshinobu Ishikawa, Tokyo (JP); Tadashi Munakata, Tokyo (JP); Yoshio Ogimura, Saitama (JP); Nobuhiko Teshima, Kokubunji (JP); Shigeo Nakagaki, Saitama (JP); Hitoshi Kawamoto, Tokyo (JP); Kenichi Fujii, Hyogo (JP); Tomohiko Matsuura, Hyogo (JP); Yoshifumi Ikeda, Tokyo (JP); Kazuhisa Hara, Tokyo (JP); Takayuki Kikuchi, Hyogo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/504,855

(22) PCT Filed: Feb. 28, 2003

(86) PCT No.: PCT/JP03/02387

§ 371 (c)(1),
(2), (4) Date: Apr. 21, 2006

(87) PCT Pub. No.: WO03/072481

PCT Pub. Date: Sep. 4, 2003

(65) Prior Publication Data

US 2007/0007106 A1 Jan. 11, 2007

(30) Foreign Application Priority Data

Feb. 28, 2002 (JP) ..... 2002-054590

(51) Int. Cl.
*B66B 21/04* (2006.01)
*B66B 21/12* (2006.01)

(52) U.S. Cl. ..... 198/330; 198/326; 198/334

(58) Field of Classification Search ..... 198/326, 198/330

See application file for complete search history.

(56) References Cited

U.S. PATENT DOCUMENTS 2,686,585 A * 8/1954 Margles et al. ..... 198/332
4,498,890 A 2/1985 Sutherland
5,697,486 A * 12/1997 Krampl ..... 198/332

(Continued)

FOREIGN PATENT DOCUMENTS

DE 199 58 709 6/2001

(Continued)

OTHER PUBLICATIONS

U.S. Appl. No. 11/816,540, filed Aug. 17, 2007, Kikuchi et al.

*Primary Examiner*—Gene O. Crawford
*Assistant Examiner*—Kavel P Singh
(74) *Attorney, Agent, or Firm*—Oblon, Spivak, McClelland, Maier & Neustadt, P.C.

(57) ABSTRACT

A mountainous or valley-shaped curved part 13 is provided in a part of a footstep guide rail 3 for guiding a movement of footstep rollers 5 linked by a footstep chain 7, the part being positioned in the vicinity of a drive sprocket 9. Consequently, owing to meshing of the footstep rollers 5 with the drive sprocket 9, an unevenness in velocity of the footstep rollers 5 is absorbed by the curved part 13, so that a moving velocity of the footstep rollers 5 moving on the downstream of the curved part 13 is maintained constantly, suppressing vibrating of the footsteps 4.

8 Claims, 5 Drawing Sheets

U.S. PATENT DOCUMENTS

2007/0007106 A1 1/2007 Ishikawa et al.

FOREIGN PATENT DOCUMENTS

| | | |
|---|---|---|
| JP | 1-34915 | 7/1989 |
| JP | 2-243489 | 9/1990 |
| JP | 8-108986 | 4/1996 |
| JP | 08-217368 | 8/1996 |
| JP | 9-202583 | 8/1997 |
| JP | 2000-177965 | 6/2000 |
| JP | 2001-226063 | 8/2001 |
| JP | 2002-114472 | 4/2002 |

* cited by examiner

PRIOR ART

CONVEYER APPARATUS HAVING FOOTSTEPS

TECHNICAL FIELD

The present invention relates to a conveyer apparatus, such as an escalator and a moving walkway.

BACKGROUND ART

A conveyer apparatus, such as an escalator and a moving walkway, includes a plurality of footsteps provided with footstep rollers. Since these plural footsteps are linked to each other at predetermined pitches through an endless footstep chain driven by a chain drive mechanism, the footsteps are integrated with the footstep chain and are all constructed so as to move synchronously while leaving no space therebetween. Additionally, due to is an engagement of the footstep rollers with a footstep guide rail disposed in a structure, these plural footsteps are adapted so as to move between an entrance and an exit circulatively while being supported by the footstep guide rail. Noted, for the reason that a plurality of footsteps of a moving walkway generally move in a horizontal direction, the footsteps may be called footplates in some cases. In this specification, however, the notation will be unified to footsteps also in case of the moving walkway.

As the chain drive mechanism to drive the footstep chain, it is general that a turn-over end of the footstep chain is wound around a drive sprocket rotating on receipt of a driving force of a drive motor, while the driving force of the motor is transmitted to the footstep chain through the drive sprocket. Such a chain drive mechanism is normally accommodated in a structure called a truss near an entrance of the conveyer apparatus or an exit thereof.

Meanwhile, it has been heretofore thought that the truss accommodating the chain drive mechanism requires enough space for its installation work. In recent years, however, the miniaturization of truss is accomplished by the progress of installation technique etc. As a result, there are carried out attempts to make the whole conveyer apparatus thin in order to save its installation space. If the truss is miniaturized in the above-noted manner, then it is required to use a small-diameter sprocket for the drive sprocket of the chain drive mechanism. However, the utilization of such a small-diameter sprocket for the drive sprocket of the chain drive mechanism may cause the footstep rollers linked by the footstep chain to move at a moving velocity with a relatively great unevenness. This velocity unevenness of the footstep rollers causes vibrations of the footsteps, so that the riding quality of the conveyer apparatus is deteriorated.

For example, Japanese Patent Application Laid-open (Hei) No. 8-217368 proposes a technique to suppress such a velocity unevenness for smooth movement of the footstep rollers. According to the technique disclosed in Japanese Patent Application Laid-open (Hei) No. 8-217368, as is shown in FIG. 1, a relative positional relationship between a footstep guide rail 102 and a drive sprocket 103 is established so that a bearing surface (traveling track) 102*a* of the footstep guide rail 102 linked by a footstep chain 100 is positioned apart from a tangential line 103*a* of the drive sprocket 103 by an interval ho. Further, a compensating rail 104 is arranged on the leading side of the footstep guide rail 102 adjacent to the drive sprocket 103. In this compensating rail 104, its bearing surface (traveling track) 104*a* for supporting footstep rollers 101 has the same height, on its side close to the footstep guide rail 102, as that of the bearing surface 102 of the footstep guide rail 102 and has also the same height, on the side close to the drive sprocket 103, as that of a groove in mesh with the footstep roller 101 of the drove sprocket 103. Further, an intermediate portion of the bearing surface 104*a* is curved smoothly. In operation, the footstep rollers 101 traveling while being supported by the bearing surface 104*a* of the compensating rail 104 are engaged with the groove of the drive sprocket 103 via the rollers' linear motion and the next curvilinear motion and thereafter, the rollers 101 rotate corresponding to the rotation of the drive sprocket 103. The velocity unevenness of the footstep rollers 101 is suppressed by the above-mentioned movements of the rollers.

Although the above-mentioned prior art enables the velocity unevenness of the footstep rollers 101 to be suppressed effectively, it is disadvantageous in view of the thin formation of the conveyer apparatus as a whole since the footstep guide rail 102 is positioned higher than the drive sprocket 103. In detail, as the interval ho between the tangential line 103*a* of the drive sprocket 103 and the bearing surface 102*a* of the footstep guide rail 102 has a value proportional to a link length of the footstep chains 100, the link length of the footstep chain 100 in relation to the drive sprocket 103 becomes a relatively great value especially in case of using a small-diameter sprocket for the drive sprocket 103. As a result, the interval ho between the tangential line 103*a* of the drive sprocket 103 and the bearing surface 102*a* of the footstep guide rail 102 grows larger. Thus, the truss is large-sized to be an obstacle to the thin formation of the conveyer apparatus as a whole.

Further, considering a situation where outward and homeward routes are reversed to operate the conveyer apparatus, it is necessary to establish also the homeward side of the footstep guide rail 102 under the drive sprocket 103 at the similar interval ho, thereby requiring a considerable height of the apparatus for such upper and lower intervals (2×ho).

Provided that the drive sprocket 103 is formed with 348.4 mm in the diameter of pitch circle and eight teeth and the link length of the footstep chain 100 is 133.33 mm, the interval ho between the tangential line 103*a* of the drive sprocket 103 and the bearing surface 102*a* of the footstep guide rail 102 has to be more than 35.3 mm in order to completely eliminate the velocity unevenness of the footstep roller 101 in the above-mentioned prior art, according to the inventors' trial calculation. Further totalizing both the outward side and the homeward side of the apparatus, it is necessary for the apparatus to make sure of an extra height of 70.6 mm (2×ho) in addition to the size of the drive sprocket 103. Thus, it results in spoiling the space-saving effect that is brought by reducing the diameter of pitch circle of the drive sprocket 103 down as far as 348.4 mm.

DISCLOSURE OF INVENTION

The present invention is invented to take the above conventional situation into consideration. It is an object of the present invention to provide a conveyer apparatus that effectively suppresses the velocity unevenness of the footstep rollers in order to assure the comfortable riding quality and that can realize the thin formation of the apparatus as a whole.

The conveyer apparatus of the present invention comprises: a footstep guide rail; a plurality of footsteps having footstep rollers moving along the footstep guide rail; a footstep chain for connecting the footstep rollers of the footsteps with each other at predetermined pitches; a rotation driving device for generating a driving force to move the footsteps in a designated direction; and a drive sprocket that rotates due to the driving force of the rotation driving device and further transmits the driving force of the rotation driving device to the footstep chain, wherein the footstep guide rail is provided, in a part thereof in the vicinity of the drive sprocket, with a mountainous or valley-shaped curved part.

In this conveyer apparatus, when the rotation driving device is activated, the drive sprocket rotates on receipt of a driving force of the rotation driving device, so that the rotation of the drive sprocket allows the driving force of the rotation driving device to be transmitted to the footstep chain. When the footstep chain is driven, the respective footsteps rollers of the plural footsteps, which are linked to each other by the footstep chain, move along the footstep guide rail circulatively thereby to convey passengers on the footsteps.

In the respective footstep rollers linked to each other by the footstep chain, we now focus attention on three adjacent footstep rollers. When the leading footstep roller approaches the drive sprocket thereby to climb over a predetermined position (reference position), the moving velocity of the leading footstep roller becomes smaller than an average velocity of the rollers. Then, when the second footstep roller arrives at the curved part of the footstep guide rail in the vicinity of the drive sprocket, the level of the second footstep roller changes corresponding to the mountainous or valley-shaped contour of the curved part. Since the pitch (link length) of the respective footstep rollers is constant, the change in the level of the second footstep roller causes the third footstep roller to approach the leading footstep roller by an amount of change in the level of the second footstep roller, so that the third footstep roller is accelerated. Consequently, the descent in the moving velocity of the leading footstep roller is cancelled by an increase in the moving velocity of the third footstep roller, so that the moving velocity of the third footstep roller is maintained at the average velocity.

When the leading footstep roller advances furthermore, its moving velocity becomes faster than the average velocity conversely. Then, if the second footstep roller passes through the curved part of the footstep guide rail, the level of the second footstep roller returns and the third footstep roller departs from the leading footstep roller, so that the third footstep roller is decelerated. Consequently, the increase in the moving velocity of the leading footstep roller is cancelled by a slowing-down in the moving velocity of the third footstep roller, so that the moving velocity of the third footstep roller is maintained at the average velocity.

As mentioned above, in the conveyer apparatus of the present invention, since the unevenness in velocity generated in the leading footstep roller is absorbed by the curved part formed in the footstep guide rail's part in the vicinity of the drive sprocket so that the velocity unevenness of the leading footstep roller is not transmitted to the following footstep rollers, it is possible to maintain a nearly average velocity of the footstep rollers in an area except the vicinity of the drive sprocket and also possible to suppress so the vibrations of the footsteps due to the velocity unevenness in the footstep rollers thereby ensuring the comfortable riding quality of the apparatus. Noted, since the vicinity of the drive sprocket is normally covered with a comb plate where a comb is attached to a leading end of the comb plate and the footsteps are adapted so as to pass under the comb plate, the velocity unevenness of the footstep roller moving near the drive sprocket does not have an influence on the riding quality.

Additionally, since the mountainous or valley-shaped contour of the curved part of the footstep guide rail does not need to be very large, it is advantageous in view of realizing a thin formation of the apparatus as a whole.

BEST MODE FOR CARRYING OUT THE INVENTION

Referring to the accompanying drawings, various embodiments of the present invention will be described below.

Figure 1:
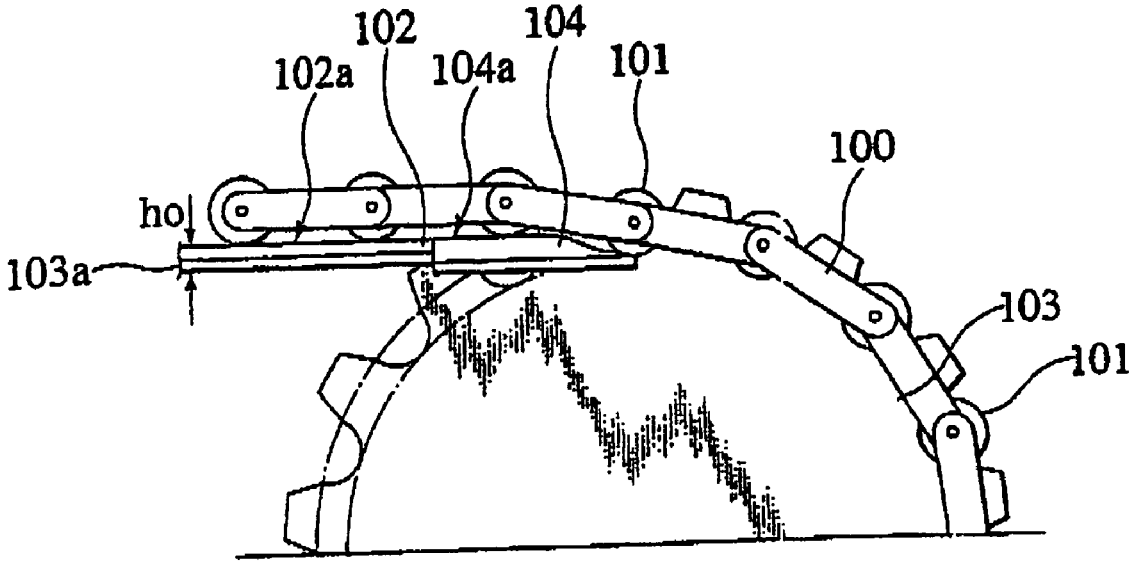
FIG. 1 is an enlarged view showing a substantial part of a chain driving mechanism of a conventional conveyer apparatus.
Figure 2:
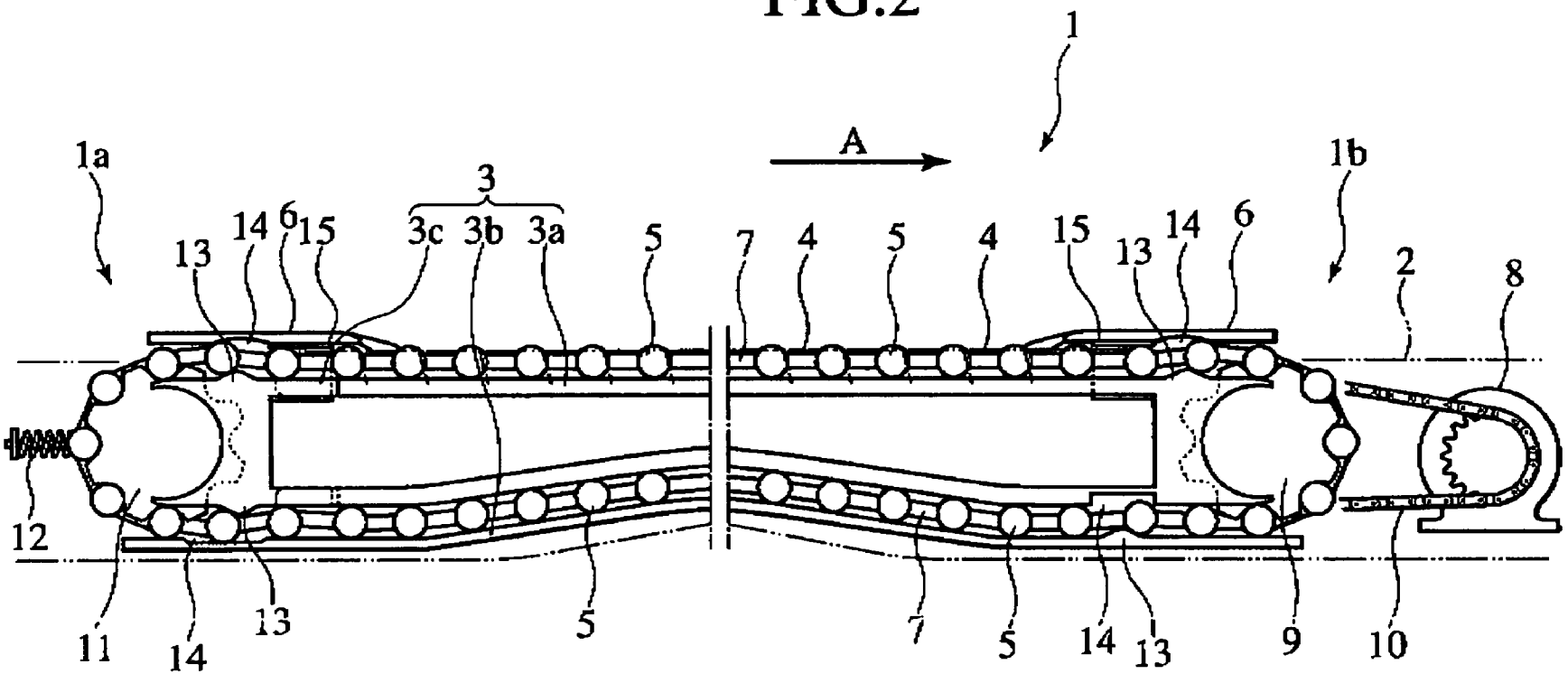
FIG. 2 is a whole structural view showing one example of a conveyer apparatus to which the present invention is applicable.

The whole constitution of a conveyer apparatus to which the present invention is applied is shown in FIG. 2 schematically. The conveyer apparatus 1 shown in FIG. 2 is constructed as a moving walkway arranged substantially horizontally to a road surface to convey passengers and includes a structure 2 called truss for supporting its own weight and loads of the passengers. This structure 2 is constructed so as to be accommodated in a pit formed below the load surface.

In the structure 2, a footstep guide rail 3 is arranged so as to extend from an entrance 1*a* of the conveyer apparatus 1 to an exit 1*b* thereof. This footstep guide rail 3 is an element to guide movements of a plurality of footsteps 4 for conveying passengers. That is, the plural footsteps 4 are provided with footstep rollers 5 respectively, so that movements of the footstep rollers 5 along the footstep guide rail 3 allow a circulative movement of the respective footsteps 4 from the entrance 1*a* of the conveyer apparatus 1 to the exit 1*b*.

The footstep guide rail 3 includes a rail body 3*a* having a bearing surface on an outward side of the guide rail and a pusher rail 3*b* arranged on the homeward side of the guide rail. Owing to a structure where the footstep rollers 5 are supported on the bearing surf ace of the rail body 3*a*, the footsteps 4 moving on the outward side of the guide rail 3 are adapted so as to translate from the entrance 1*a* toward the exit 1*b* in a direction of arrow A of FIG. 2 while exposing their respective step surfaces to the outside of the structure 2, at the same level as the road surface substantially. Noted, in the vicinity of the entrance 1*a* and the exit 1*b* on the outward side, comb plates 6 are provided, at respective tips, with combs, while the footsteps 4 are adapted so as to move under the comb plate 6.

The footsteps 4 moving on the homeward side are adapted so as to return from the exit 1*b* to the entrance 1*a* while the footstep rollers 5 are being engaged between the rail body 3*a* and the pusher rail 3*b*. Additionally, on the side of the rail body 3*a* close to the entrance 1*a*, there is provided a movable rail 3*c* that can move in a direction to depart from the rail body 3*a*.

The plural footsteps 4 are integrated with the footstep chain 7 since the footstep rollers 5 of the respective footsteps 4 are linked with each other through the endless footstep chain 7 at predetermined pitches. The footstep chain 7 is driven by the chain driving mechanism in the state that the footstep rollers 5 of the respective footsteps 4 about against the footstep guide rail 3. Then, the respective footsteps 4 move between the entrance 1*a* and the exit 1*b* with no clearance while being guided by the footstep guide rail 3.

In the chain driving mechanism, a turn-over part of the footstep chain 7 is wound on a drive sprocket 9 rotating on receipt of the driving force of a drive motor 8, so that the driving force of the drive motor 8 is transmitted to the footstep chain 7 through the drive sprocket 9.

The drive motor 8 forming a driving source is disposed in the structure 2 and connected to the drive sprocket 9 through a drive chain 10. The drive sprocket 9 is positioned on the side of the exit 1*b* of the conveyer apparatus 1 and also arranged to be rotatable in the structure 2. Receiving the driving force of the drive motor 8, the drive sprocket 9 rotates so as to transmit the driving force of the drive motor 8 to die footstep chain 7. That is, in the state that the footstep rollers 5 linked with each other through the footstep chain 7 are respectively engaged between adjoining gear teeth of the drive sprocket 9, it rotates by the driving force of the drive motor 8 thereby allowing the footstep chain 7 and the associating footstep rollers 5 to carry out respective feeding motions. In the conveyer apparatus 1 according to the present invention, a small-diameter sprocket having a small number of teeth, for example, eight teeth is employed for the drive sprocket 9. By adopting such a small-sized sprocket as the drive sprocket 9, the miniaturization of the structure 2 and the thin formation of the conveyer apparatus 1 as a whole are accomplished to save a space for the installation.

Further, the conveyer apparatus 1 is provided, on the side of the entrance 1*a*, with a driven sprocket 11 that is rotated by the drive sprocket 9 to feed the footstep chain 7 in cooperation with the drive sprocket 9. This driven sprocket 11 is formed with a diameter substantially equal to that of the drive sprocket 9 and is arranged so as to be rotatable in the structure 2. The footstep chain 7 is hooked on and from the driven sprocket 11 to the drive sprocket 9.

This driven sprocket 11 is urged in a direction so as to depart from the drive sprocket 9 by a spring member 12 of a chain tensional mechanism, so that the driven sprocket 11 applies an appropriate tension on the footstep chain 7. Then, if an elongation is produced in the footstep chain 7, an urging force of the spring member 12 of the chain tensional mechanism allows the driven sprocket 11 to move in a direction to depart from the drive sprocket 9 within a predetermined range, thereby preventing relaxation of the footstep chain 7. Noted, due to the urging force of the spring member 12 of the chain tensional mechanism, the above-mentioned movable rail 3*c* of the footstep guide rail 3 is constructed so as to move in a direction to depart from the drive sprocket 9 in association with the driven sprocket 11 during its moving.

Meanwhile, it is noted that, during the course of changing from the rollers' straight movement following the footstep guide rail 3 to their curved movement following the drive sprocket 9, the footstep rollers 5 moving along the footstep guide rail 3 due to the linkup of the footstep chain 7 are subjected to an unevenness in the moving velocity of the roller 5 under the influence of meshing into the drive sprocket 9. The smaller the diameter of the drive sprocket 9 gets, the more remarkable the velocity unevenness of the footstep rollers 5 does become. In such case, the footsteps 4 are vibrated to cause the riding quality of the conveyer apparatus 1 to be deteriorated.

Therefore, in the conveyer apparatus 1 according to the present invention, a mountainous curved part 13 is formed to absorb the velocity unevenness of the footstep rollers 5 at an appropriate position of the footstep guide rail 3, for example, in the vicinity or the rail body 3*a* on the homeward side. Here, the vicinity of the drive sprocket 9 means a region close to the drive sprocket 9, for example, an area covered with the comb plate 6.

In order to absorb the velocity unevenness of the footstep rollers 5, this conveyer apparatus 1 further includes additional mountainous curved parts 13: one is arranged in part of the pusher rail 3*b* on the homeward side of the footstep guide rail 3 and is in the vicinity of the drive sprocket 9 and the others are arranged in respective parts of the movable rail 3*c* on both outward and homeward sides thereof and in the vicinity of the driven sprocket 11. Consequently, the footstep rollers 5 are adapted so as to pass through the rails' parts having the curved parts 13 while describing the tracks corresponding to the profiles of the curved parts 13. Noted, in respective positions opposing these curved parts 13, recessed parts 14 are respectively formed so that the footstep rollers 5 can move along the curved parts 13 appropriately.

Further, in order to prevent the trailing footstep) roller 5 from being raised due to the influence of the leading footstep roller 5 passing through the curved part 13, a pusher member 15 is arranged in a position opposing the front stage of the curved part 13 on the outward side of the rail body 3*a* and in the vicinity of the drive sprocket 9. Being arranged under the comb plate 6, this pusher member 15 abuts on the top end of the footstep roller 5 moving in the vicinity of the drive sprocket 9 there by to prevent the above footstep roller 5 from lifting. Again, similarly in a position opposing the back stage of the curved part 13 on the outward side of the movable rail 3*c* and in the vicinity of the driven sprocket 11, another pusher member 15 is arranged so as to abut on the top end of the footstep roller 5 thereby preventing the footstep roller 5 from lifting. Here noted that the terminology "front stage" means one side where the footstep 4 passes first in the course of its moving along the moving direction, in other words, one side of the conveyer apparatus 1 close to the entrance 1*a*. While, the terminology "back stage" means another side where the footstep 4 passes subsequently in the course of its moving along the moving direction A, in other words, another side of the conveyer apparatus 1 close to the exit 1*b*.

If the above curved part 13 is arranged at least in the part of the rail body 3*a* on the outward side and in the vicinity of the drive sprocket 9, then it is possible to absorb the velocity unevenness of the footstep rollers 5 effectively thereby accomplishing their smooth movement and also possible to suppress vibrations of the footsteps 4 effectively. Nevertheless, owing to the additional provision of the curved part 13 in the part of the pusher rail 3*b* on the homeward side of the footstep guide rail 3 and in the vicinity of the drive sprocket 9, even if operating the conveyer apparatus 1 in reverse, it is possible to make the movement of the footstep) rollers 5 smooth, whereby the vibrations of the footsteps 4 can be suppressed effectively.

Further, although the rotating speed of the driven sprocket 11 has a tendency to become unstable under the influence of a velocity unevenness of the footstep rollers 5, the provision of the curved parts 13 in the parts of the movable rail 3*a* on both outward and homeward sides and in the vicinity of the driven sprocket 11 allows the velocity unevenness of the footstep rollers 5 on the side of the driven sprocket 11 to be suppressed effectively thereby to stabilize the rotating speed of the driven sprocket 11. Thus, it is possible to restrict the vibrations of the footsteps 4 more effectively and also possible to meet the reverse operation of the conveyer apparatus 1.

In the above explanation, the mountainous curved parts 13 are taken as examples. However, even if the curved parts 13 are valley-shaped, then it becomes possible to absorb the velocity unevenness of the footstep rollers 5, whereby the vibrations of the footsteps 4 can be restricted effectively, as well.

Figure 3:
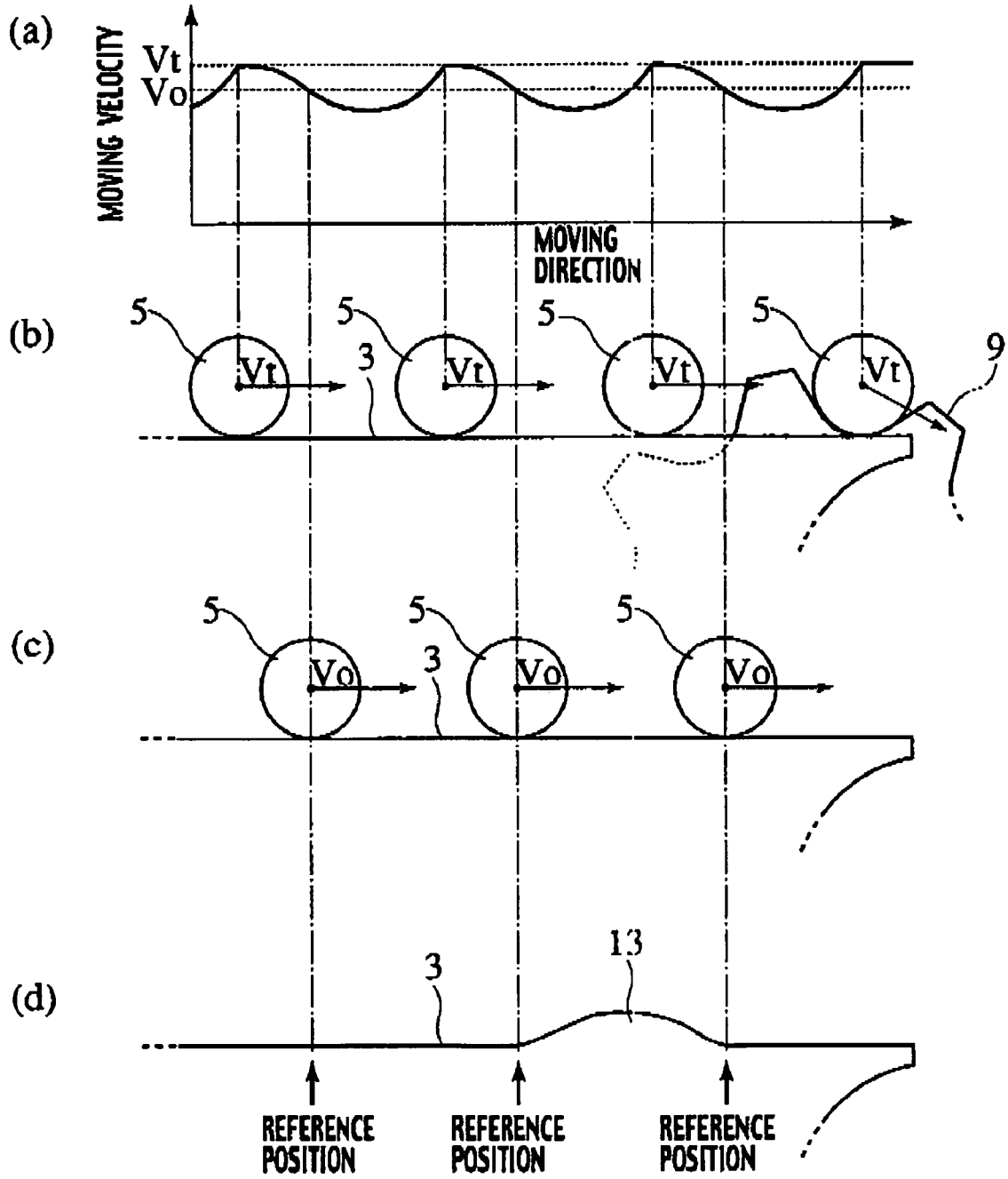
FIG. 3 is composed of views explaining a relationship between moving velocities of footstep rollers and their position in the above conveyer apparatus: (a) is a view showing changes in moving velocity of the footstep rollers corresponding to their positions; (b) a view showing positions where the moving velocity of the footstep roller becomes a pitch-circle velocity Vt of a drive sprocket; (c) a view showing positions where the moving velocity of the footstep roller becomes an average velocity Vo; and (d) is a view showing a desirable forming position of a bending part.
Figure 4:
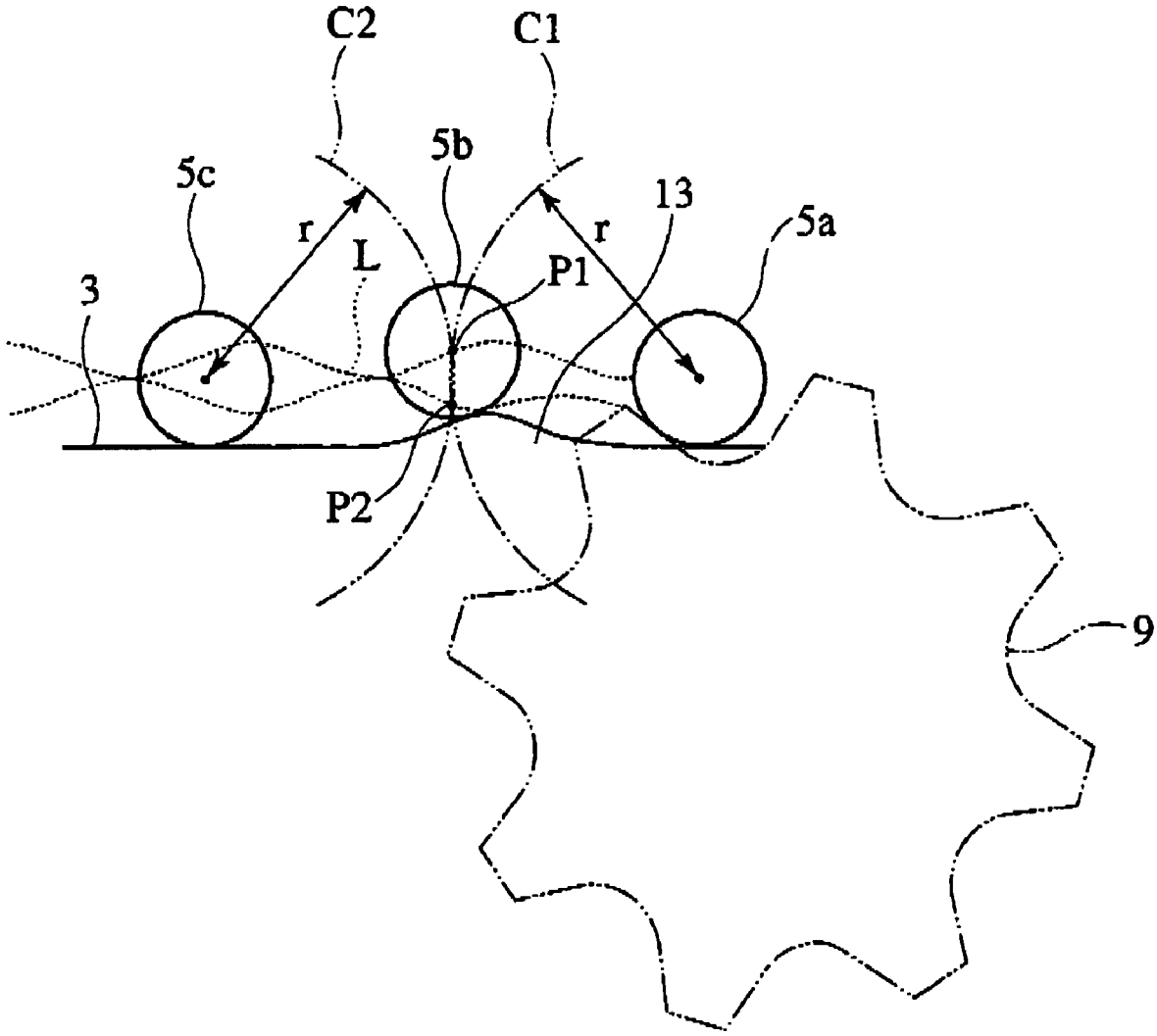
FIG. 4 is a type view explaining an appropriate configuration of the bending part.

Now referring to FIGS. 3 and 4, we describe the curved part 13 for absorbing such a velocity unevenness of the footstep rollers 5 more in detail.

Under the influence of driving the footstep rollers 5 in linear movement by using the circular drive sprocket 9, the footstep rollers 5 are subjected to an unevenness in velocity as shown in FIG. 3(*a*). Provided that a pitch circle of the drive sprocket 9 is represented by Vt, the respective footstep rollers 5 are subjected to the velocity unevenness such that the velocity Vt is once reduced and thereafter increased up to the velocity Vt. Provided herein that an average velocity of the footstep rollers 5 is represented by Vo, when the footstep roller 5 is at respective positions shown in FIG. 3(*b*) on the footstep guide rail 3, the moving velocity of the footstep rollers 5 comes to Vt. Subsequently, when the footstep roller 5 advances against the drive sprocket 9 by a predetermined distance while reducing the moving velocity from the above positions, the moving speed of the footstep rollers 5 comes to the average velocity Vo.

Provided that positions at which the moving velocity of the footstep rollers 5 comes to Vo as a result of reducing from Vt are represented by "reference positions", the curved part 13 is formed in a manner that the is footstep guide rail's part between two adjoining reference positions along the footstep guide rail 3 has a curved configuration, as shown in FIG. 3(*d*). In operation, when a certain roller 5 of the respective footstep rollers 5 linked by the footstep chain 7 moves along the curved configuration of the curved part 13, a level of the certain roller 5 changes. Consequently, the velocity unevenness of another footstep roller 5 preceding the certain footstep roller 5 is absorbed by the change in level of the certain roller. Thus, the velocity unevenness is not transmitted to the following footstep roller 5, so that the moving velocity of the following footstep roller 5 is maintained at the average velocity Vo.

As mentioned above, the curved part 13 has a function to prevent a velocity unevenness of the footstep roller 5 following on the footstep roller 5 passing through the curved part 13. Considering this point of view, it is desirable to form the curved part 13 in a position close to the exit 1*b* of the conveyer apparatus 1 as possible. That is, if forming the curved part 13 in a position close to the exit 1*b* of the conveyer apparatus 1, then it is possible to maintain the moving velocity of the footstep rollers 5 traveling from the entrance 1*a* to the exit 1*b* at the average velocity Vo, over the substantial whole area extending from the entrance 1*a* to the exit 1*b*.

From the above point of view, in the conveyer apparatus 1 according to the present invention, there is provided the curved part 13 in a part of the footstep guide rail 3, which part is positioned, among plural reference positions along the footstep guide rail 3, between one reference position in the vicinity of the drive sprocket 3 on the side of the exit 1*b* of the conveyer apparatus 1 and another reference position adjoining the above reference position. Consequently, it is possible to maintain a substantially-constant moving velocity of the footstep rollers 5 in the substantial whole area from the entrance 1*a* of the conveyer apparatus 1 to the exit 1*b* but the vicinity of the drive sprocket 3, whereby the vibrations of the footsteps 4 can be restrained effectively. Noted, as mentioned above, the vicinity of the drive sprocket 3 is covered with the comb plate 6 to allow the footsteps 4 to pass below the comb plate 6. Therefore, the velocity unevenness of the footstep rollers 5 moving near the drive sprocket 3 would no effect on riding quality of the conveyer apparatus 1.

Next, an optimal profile of the curved part 13 will be described with reference to FIG. 4.

As mentioned above, the footstep roller 5 approaching the drive sprocket 9 over the curved part 13 travels with a velocity unevenness under the influence of meshing with the drive sprocket 9. In die specification, such a footstep roller 5 positioned between the curved part 13 and the drive sprocket 9 and traveling with the velocity unevenness as above will be called "velocity unevenness roller 5*a*", for the sake of simplicity. Further, another footstep roller 5, which is the second one to a direction from the velocity unevenness roller 5*a* toward the side of the front stage of the footstep guide rail 3 (i.e. the side of the entrance 11*a* of the conveyer apparatus 1) via the curved part 13, moves at a constant velocity (average velocity Vo) because a footstep roller 5*b* adjoining the velocity unevenness roller 5*a* moves along the curved part 13. In the specification, such a footstep roller, which is the second one to a direction from the velocity unevenness roller 5*a* toward the side of the front stage of the footstep guide rail 3 via the curved part 13 and which is expected to have a constant velocity, will be called "constant-velocity roller 5*c*"; for the sake of simplicity.

Now provided that a roller's center trace L represents each trace of intersecting points P1, P2 during moving of the respective footstep rollers 5*a*, 5*b* and 5*c* by one pitch each, it is desirable that the curved part 13 is formed so as to follow the roller's center trace L. Noted, the intersecting points P1, P2 are obtained by an intersection between a circle C1 that can be described by both a center of the velocity unevenness roller 5*a* and a link length r of the footstep chain 9 as the radius of the circle C1 and another circle C2 that can be described by both a center of the constant-velocity roller 5*c* and the link length r of the footstep chairs 9 as the radius of the circle C2. In other words, it is preferable that the curved part 13 coincides with the profile of the roller's center trace L.

With the above establishment of the profile of the curved part 13, in the course that the footstep roller 5*b* between the velocity unevenness roller 5*a* and the constant-velocity roller 5*c* passes through the curved part 13, the velocity unevenness about the velocity unevenness roller 5*a* can be completely absorbed by a change in the level of the footstep roller 5*b* corresponding to the profile of the curved part 13, theoretically. Consequently, the moving velocity of the constant-velocity roller 5*c* is maintained to a constant velocity (average velocity Vo) precisely.

Provided herein that the drive sprocket 9 is formed with 348.4 mm in the diameter of pitch circle and eight teeth and the link length of the footstep chain 7 is 133.33 mm and that the curved part 13 is formed so as to have a profile following the above-mentioned center trace L, the vertical interval of the curved part 13 becomes 11.2 mm according to the inventors' trial calculation.

As mentioned above, in the conveyer apparatus 1 according to the present invention, since the curved part 13 with a profile following the above-mentioned center trace L is formed in the part of the footstep guide rail 3 in the vicinity of the drive sprocket 9 so that the footstep rollers 5 linked by the footstep chain 7 pass through the curved part 13, it is possible to make the moving velocity of the footstep roller 5 following the footstep roller 13 passing through the curved part 13 constant and also possible to suppress the vibrations of the footsteps 4 effectively, thereby accomplishing comfortable riding quality. Since the vertical interval of the curved part 13 is remarkably small as mentioned above, the structure 12 can be miniaturized to allow the whole conveyer apparatus 1 to be formed thinly.

As for the plural reference positions existing along the footstep guide rail 3, it is noted that, in an area between the nearest reference position to the drive sprocket 9 and another reference position adjoining the nearest reference position, valley-shaped one of the roller's center traces L within this area does not a geometrically-complete trace since the movement of the footstep roller 5 passing through the area is changed to a circular motion due to the meshing with the drive sprocket 9. Therefore, if it is required to form the curved part 13 in this area in view of any constraint, such as size of the comb plate 6, it is desirable to establish the mountainous curved part 13 following the mountainous center trace L. When forming the curved part 13 in the other area, the profile of the curved part 13 may be either mountainous to follow the mountainous center trace L or valley-shaped to follow the valley-shaped center trace L. In case of the valley-shaped curved part 13, it is advantageous to thin-formation of the conveyer apparatus 1 as a whole since there is no part projecting in the direction of height.

Hitherto, the arrangement to precisely maintain a constant velocity (average velocity Vo) of the footstep rollers 5 following the footstep roller 5 passing through the curved part 13 has been described. However, when the footstep rollers 5 are allowed to have a vary small amount of velocity unevenness ($Vo-r\omega \sin(\omega t+\phi)$), the curved pact 13 may be formed with a profile having a smaller vertical interval.

That is, hereat, a footstep roller 5 positioned between the curved part 13 and the drive sprocket 9 and having the velocity unevenness is defined as the velocity unevenness roller 5*a*. While, a footstep roller 5, which is the second one to a direction from the velocity unevenness roller 5*a* toward the side of the front stage of the footstep guide rail 3 (the side of the entrance 1*a* of the conveyer apparatus 1) via the curved part 13 and which is expected to have a small velocity unevenness ($Vo-r\,\omega \sin(\omega t+\phi)$) because the footstep roller 5*b* adjoining the velocity unevenness roller 5*a* moves along the curved part 13, is defined as a substantial constant-velocity roller 5*c*. Then, it is assumed that a roller's center trace L represents each trace of intersecting points P1, P2 during moving of the respective footstep rollers 5*a*, 5*b* and 5*c* by one pitch each and that the intersecting points P1, P2 are obtained by an intersection between a circle C1 that can be described by both a center of the velocity unevenness roller 5*a* and a link length r of the footstep chain 9 as the radius of the circle C1 and another circle C2 that can be described by both a center of the substantial constant-velocity roller 5*c* and the link length r of the footstep chain 9 as the radius of the circle C2. Under the definitions, if forming the curved part 13 having a profile following the roller's center trace L, then it becomes possible to restrain the velocity unevenness of the footstep roller 5 following the footstep roller 5 passing through the curved part 13 within an allowable range while reducing the vertical interval of the curved part 13

Provided that the drive sprocket 9 is formed with 348.4 mm in the diameter of pitch circle and eight teeth, the link length of the footstep chain 7 is 133.33 mm; the average velocity Vo of the footstep rollers 5 is 30 m/min. and that the allowable velocity unevenness is equal to 20 gal ($=\pm 0.1\ m/s^2$), it is possible to make the vertical interval of the curved part 13 less than 9 mm according to the inventors' trial calculation.

In the above-noted manner, when the footstep rollers 5 are allowed to have a very small amount of velocity unevenness, it is possible to realize the thin formation of the whole conveyer apparatus 1 advantageously so long as the vertical interval of the curved part 13 is reduced.

We now describe the operation of the conveyor apparatus 1 constructed above.

First, when the drive motor 8 forming a driving source of the chain tensional mechanism is activated, the drive sprocket 9 rotates on receipt of a driving force of the drive motor 8, so that the rotation of the drive sprocket 9 allows the driving force of the drive motor 8 to be transmitted to the footstep chain 7. When the footstep chain 7 is driven, the respective footsteps rollers 4 of the plural footsteps 4 linked 10 each other by the footstep chain 7 move along the footstep guide rail 3 circulatively.

In the respective footsteps rollers 4 linked by the footstep chain 7, then, a footstep roller 5 approaching the drive sprocket 9 is subjected to an unevenness in the moving velocity in the process of meshing with the drive is sprocket 9. However, since a footstep roller 5 following this footstep roller 5 having the velocity unevenness passes through the curved part 13 in the vicinity of the drive sprocket 9 of the footstep guide rail 3, the unevenness in velocity of a footstep roller 5 following the footstep roller 5 passing through the curved part 13 is restrained.

We now describes the respective footstep rollers 5 linked to each other by the footstep chain 7 in detail while focusing attention on three adjacent footstep rollers 5*a*, 5*b*, 5*c*. When the leading footstep roller 5*a* approaches the drive sprocket 9 to climb over the above-mentioned reference position, the moving velocity of the leading footstep roller a becomes smaller than the average velocity Vo. Then, when the second footstep roller 5*b* arrives at the curved part 13 of the footstep guide rail 3 in the vicinity of the drive sprocket 9, the second footstep roller 5*b* moves along the curved part 13 while changing its level.

Since the pitch (link length) of the respective footstep rollers 5 is so constant, the change in the level of the second footstep roller 5*b* causes the third footstep roller 5*c* to approach the leading footstep roller 5*a* by an amount of change in the level of the second footstep roller 5*b*, so that the third footstep roller 5*c* is accelerated. Consequently, the decrease in the moving velocity of the leading footstep roller 5*a* is cancelled by an increase in the moving velocity of the third footstep roller 5*c*, so that the moving velocity of the third footstep roller 5*c* is maintained at the average velocity Vo.

When the leading footstep roller 5*a* advances furthermore, its moving velocity becomes faster than the average velocity Vo conversely. At this time, since the second footstep roller 5*b* has just passed through a peak of the curved part 13 of the footstep guide rail 3 in the vicinity of the drive sprocket 9, the level of the second footstep roller 5*b* returns and the third footstep roller 5*c* departs from the leading footstep roller 5*a*, so that the third footstep roller 5*c* is decelerated. Consequently, the increase in moving velocity of the leading footstep roller 5*a* is cancelled by a slowing-down in the moving velocity of the third footstep roller 5*c*, so that the moving velocity of the third footstep roller 5*c* is maintained at the average velocity Vo.

Again noted, at this time, the pusher member 15 operates to prevent the third footstep roller 5*c* from being lifted up though a predetermined tension is applied on the footstep chain 7 by the above-mentioned chain tensional mechanism. Therefore, when the level of the second footstep roller 5*b* changes along the curved part 13, the third footstep roller 5*c* is properly accelerated or decelerated, so that the moving velocity of the third footstep roller 5*c* is maintained at the average velocity Vo certainly.

Additionally, in the above-mentioned arrangement where the curved parts 13 are formed not only in the footstep guide rail's part in the vicinity of the drive sprocket 9 on the outward side of the footstep guide rail 3 but also in the part of the pusher rail 4*b* in the vicinity of the drive sprocket 9 on the homeward side of the footstep guide rail 3, even if the conveyer apparatus 1 is operated in reverse, it is possible to suppress the unevenness in velocity of the footstep rollers 5 effectively. Further, in the arrangement where the curved parts 13 are formed, in the vicinity of the driven sprocket 11, on both outward and homeward sides of the movable rail 3*c* positioned on the side of the entrance 1*a* of the conveyer apparatus 1, it is possible to suppress even the velocity unevenness on the side of the driven sprocket 11 effectively.

As mentioned above, since the conveyer apparatus 1 according to the present invention is constructed so that the curved part 13 of the footstep guide rail 3 absorbs the velocity unevenness in the moving velocity of the footstep roller 5 generated due to the meshing of the footstep roller 5 with the drive sprocket 9 whereby the footstep rollers 5 on the downstream side of the curved part 13 can move at a constant velocity, it is possible to suppress vibrations of the footsteps 4 whereby the comfortable riding quality of the apparatus can be ensured.

Further, since the curved part 13 provided in the footstep guide rail 3 does not necessitate such a great vertical interval, the structure 12 can be miniaturized to realize the thin formation of the conveyer apparatus 1 as a whole. Especially, in case that the footstep rollers 5 on the downstream side of the curved part 13 are allowed to move with a very small amount of velocity unevenness, the vertical interval of the curved part 13 can be reduced furthermore. Then, it is possible to form the whole conveyer apparatus 1 more thinly.

Figure 5:
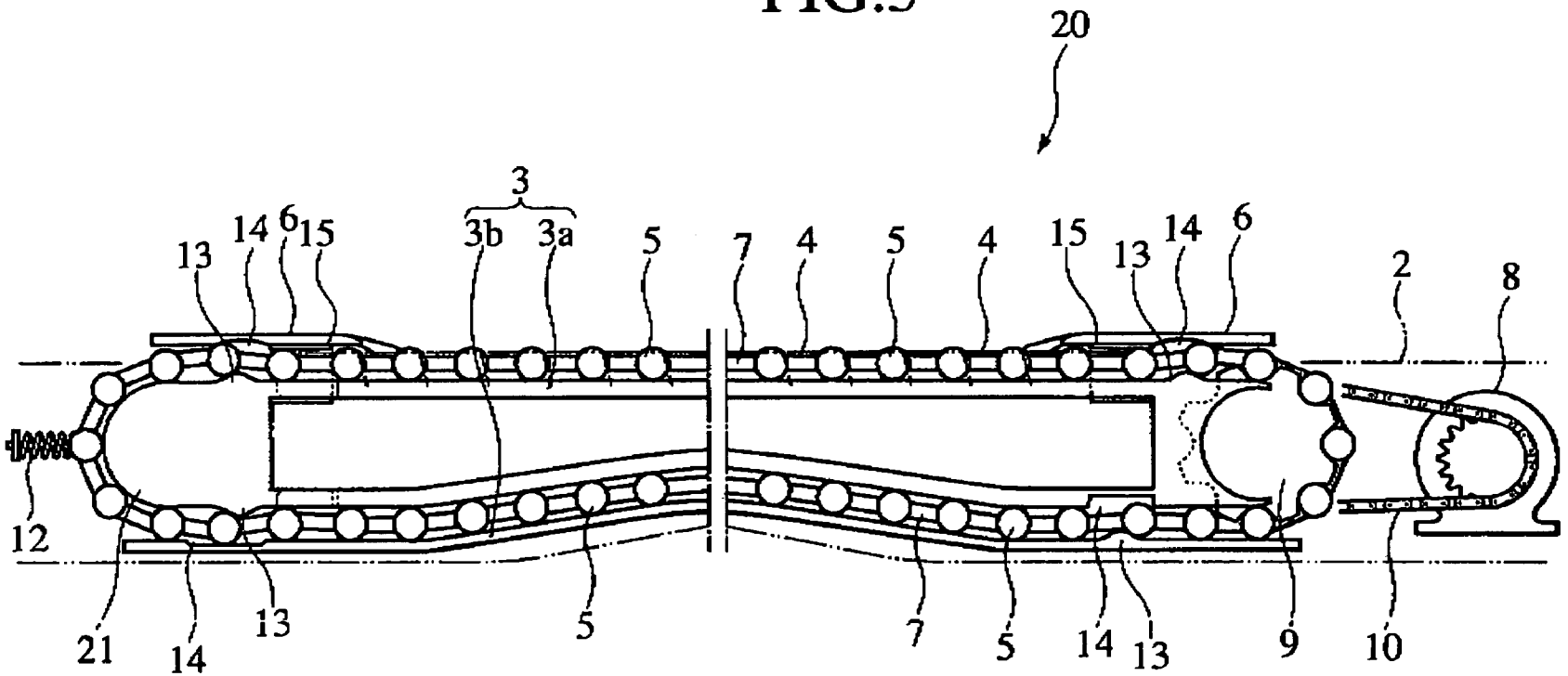
FIG. 5 is a whole structural view showing another example of the conveyer apparatus according to the present invention.

Noted, the above-mentioned conveyer apparatus 1 is nothing but one specific applicable example of the present invention and therefore, a variety of modifications may be made without any departure from the purpose of the present invention. For instance, although the footstep chain 9 is spanned between the drive sprocket 9 and the driven sprocket 11 in the above-mentioned conveyer apparatus 1, a substantially U-shaped movable rail 21 may be employed in place of the driven sprocket 11 while the footstep chain 7 is spanned between the drive sprocket 9 and the movable rail 21, as shown in FIG. 5. Since a conveyer apparatus 20 of FIG. 5 is similar in constitution to the above-mentioned conveyer apparatus 1 except for the above feature, element similar to those of the above-mentioned conveyer apparatus 1 are indicated with the same reference numerals respectively and their descriptions are eliminated.

In the movable rail 21, its portion for engagement with the footstep chain 7 is rounded with the substantially same diameter as that of the drive sprocket 9. Thus, the movable rail 21 is adapted so as to allow the respective footstep rollers 7 linked by the footstep chain 7 to abut on the periphery of the rounded portion thereby to guide the movement of the footstep rollers 5. Again, this movable rail 21 is urged in a direction to depart from the drive sprocket 9 by the spring member 12 of the chain tensional mechanism, similarly to the driven sprocket 11 of the above-mentioned conveyer apparatus 1, thereby applying an appropriate tension on the footstep chain 7.

In the movable rail 21 like this, if the velocity unevenness is produced in the footstep rollers 5, there arises a possibility that the movable rail 21 shakes in directions to approach and leave the drive sprocket 9. Therefore, in case of adopting the movable rail 21 like this, it is desirable to provide the above-mentioned curved parts 13 on both outward and homeward sides of the movable rail 21. If the movable rail 21 is provided, on both outward and homeward sides thereof, with the curved parts 13, then the unevenness in velocity of the footstep rollers 5 on the side of the movable rail 21 is suppressed effectively, so that not only vibrations of the footsteps 4 but also vibration of the movable rail 21 can be effectively restrained to make the riding quality of the conveyer apparatus 1 remarkably favorable. Additionally, owing to the provision of the curved parts 13 on both outward and homeward sides of the movable rail 21, it is possible to cope with the reverse driving of the conveyer apparatus 20 too.

Although an example where the present invention is applied on a moving walkway arranged substantially horizontally to the road surface to convey passengers has been described as above, the present invention is also applicable to an escalator that is arranged so as to overstride upper and lower floors in order to convey passengers, effectively.

INDUSTRIAL APPLICABILITY

According to the conveyer apparatus of the present invention, since the unevenness in velocity in the moving velocity generated in the footstep roller is absorbed by the curved part formed in the footstep guide rail's part in the vicinity of the drive sprocket so as not to transmit the velocity unevenness to the footstep rollers positioned on the downstream side of the curved part, it is possible to maintain a substantial average velocity in the moving velocity of the footstep rollers in an area except the vicinity of the drive sprocket and also possible to ensure comfortable riding quality with an effective suppression for the vibrations of the footsteps due to the velocity unevenness in the footstep rollers.

Additionally, as the velocity unevenness in the moving velocity of the footstep rollers is absorbed by providing the footstep guide rail with the curved part having a small vertical interval, it is possible to realize the thin formation of the apparatus as a whole while ensuring its comfortable riding quality.

The invention claimed is:

1. A conveyer apparatus comprising:

a footstep guide rail;

a plurality of footsteps having footstep rollers moving along the footstep guide rail;

a footstep chain for connecting the footstep rollers of the footsteps with each other at predetermined pitches;

a rotation driving device for generating a driving force to move the footsteps in a designated direction; and a drive sprocket that rotates due to the driving force of the rotation driving device and further transmits the driving force of the rotation driving device to the footstep chain, wherein the footstep guide rail is provided in a part thereof in the vicinity of the drive sprocket, with a mountainous or valley-shaped curved part so that a level of the footstep roller changes corresponding to mountainous or valley-shaped contours of the curved part thereby to absorb unevenness in velocity of the footstep roller, wherein a velocity of a pitch circle of the drive sprocket is represented by Vt;

an average velocity of the footstep rollers moving while being connected to the footstep chain is represented by Vo; and a position where the velocity of the footstep rollers is reduced to change from Vt to Vo is represented by a reference position, and wherein there exist a plurality of reference positions along the footstep guide rail, and the curved part is arranged in a part of the footstep guide rail and positioned between a first reference position and a second reference position from the drive sprocket.

2. The conveyer apparatus of claim 1, wherein the curved part is identical to a mountainous curved part projecting toward the footsteps and is formed in part of the footstep guide rail, the pan being positioned on an outward side of the footstep guide rail and positioned in the vicinity of the drive sprocket.

3. The conveyer apparatus of claim 2, wherein a pusher member abutting on the footstep rollers is arranged in a position opposing a preliminary stage of the part of the footstep guide rail on the outward side, the part being provided with the curved part.

4. The conveyer apparatus of claim 1, wherein:

a footstep roller positioned between the curved part and the drive sprocket and having an unevenness in velocity is established as a velocity unevenness roller;

another footstep roller which is the second one from the velocity unevenness roller along the footstep guide rail via the curved part and which is expected to have a constant velocity, is established as a constant-velocity roller; and a trace of an intersecting point between two circles during respective moving of the velocity unevenness roller and the constant-velocity roller by one pitch each, one circle being described by a center of the velocity unevenness roller as the center of the circle and a link length of the footstep chain as the radius of the circle and another circle being described by a center of the constant-velocity roller as the center of the other circle and the link length of the footstep chain as the radius of the other circle, is established as a roller center trace, wherein the curved part is formed so as to follow the roller center trace.

5. The conveyer apparatus of claim 1, provided that:

a footstep roller positioned between the curved part and the drive sprocket and having an unevenness in velocity is established as a velocity unevenness roller;

another footstep roller which is the second one from the velocity unevenness roller along the footstep guide rail via the curved part and which is allowed to have a minimal unevenness in velocity, is established as a substantial constant-velocity roller; and a trace of an intersecting point between two) circles during respective moving of the velocity unevenness roller and the substantial constant-velocity roller by one pitch each, one circle being described by a center of the velocity unevenness roller as the center of the circle and a link length of the footstep chain as the radius of the circle and another circle being described by a center of the substantial constant-velocity roller as the center of the other circle and the link length of the footstep chain as the radius of the other circle, is established as a roller center trace, wherein the curved part is formed so as to follow the roller center trace.

6. The conveyer apparatus of claim 1, wherein the curved part is formed in part of the footstep guide rail, the part being positioned on a homeward side thereof and in the vicinity of the drive sprocket.

7. The conveyer apparatus of any claim 1, further comprising:

a driven sprocket whose diameter is substantially equal to the diameter of the drive sprocket;

a chain tensional mechanism that urges the driven sprocket in a direction to depart from the drive sprocket thereby to apply a predetermined tension on the footstep chain; and a movable rail which is movable in a direction to depart from the drive sprocket by an urging force of the chain tensional mechanism, in association with the driven sprocket, wherein the curved part is formed in part of the movable rail, the part being positioned in the driven sprocket.

8. The conveyer apparatus of claim 1, further comprising:

a movable rail having a circular part whose diameter is substantially equal to the diameter of the drive sprocket, the movable rail being arranged so as to be movable in a direction to depart from die drive sprocket; and a chain tensional mechanism that urges the movable rail in a direction to depart from the drive sprocket thereby to apply a predetermined tension on the footstep chain, wherein the curved part is formed in a part of the movable rail, the part being positioned in the driven sprocket.

* * * * *